United States Patent [19]

Cook

[11] Patent Number: 4,637,113

[45] **Date of Patent: * Jan. 20, 1987**

[54] TOOL FOR REMOVING AND REAPPLYING RIVETS

[76] Inventor: John Cook, Rte. 1, Trimble, Tenn. 38259

[ * ] Notice: The portion of the term of this patent subsequent to Oct. 16, 2001 has been disclaimed.

[21] Appl. No.: 608,451

[22] Filed: May 9, 1984

Related U.S. Application Data

[63] Continuation of Ser. No. 395,626, Jul. 6, 1982, Pat. No. 4,476,615.

[51] Int. Cl.[4] ..... B23P 11/00

[52] U.S. Cl. ..... 29/243.54; 29/283; 72/481

[58] Field of Search ..... 29/243.5, 243.53, 243.54, 29/243.55, 254, 275, 283.5, 283, 402.03, 525, 526, 251; 72/481, 453.17, 453.19; 7/170; 30/168

[56] References Cited

U.S. PATENT DOCUMENTS

| | | | |
|---|---|---|---|
| 963,924 | 7/1910 | McSherry | 72/453.17 |
| 1,767,946 | 6/1930 | Scott | 72/453.17 |
| 2,815,692 | 12/1957 | Daniels | 29/275 |
| 3,182,396 | 5/1965 | Konzak | 30/168 |
| 3,208,134 | 9/1965 | Krewson | 30/168 |
| 3,234,634 | 2/1966 | Johnson et al. | 29/243.54 |
| 3,576,064 | 4/1971 | Brackin | 29/254 |
| 3,742,591 | 7/1973 | Ritter et al. | 29/254 |

*Primary Examiner*—Robert C. Watson

*Attorney, Agent, or Firm*—Diller, Ramik & Wight

[57] ABSTRACT

This disclosure relates to a tool which is connected to a conventional air-powered chisel to remove old rivets and reapply new rivets, the tool including a collar secured by set screws to a chuck end portion of the power chisel and carrying a sleeve slidably receiving a rod which in turn has a support or arm transverse thereto, a handle is pivotally connected to the rod to move the rod relative to the sleeve for bringing the arm into intimate relationship to an associated rivet, the arm having a bore through which a rivet can pass when driven from the element by a punch associated with the power chisel, and an anvil housed relative to the bore and having a recess in an enlarged head for accommodating the head of a new rivet which is upset by a riveting bit carried by the power chisel.

4 Claims, 8 Drawing Figures

TOOL FOR REMOVING AND REAPPLYING RIVETS

This application is a continuation of application Ser. No. 395,626, filed July 6, 1982, now U.S. Pat. No. 4,476,615.

The present invention is directed to a tool adapted to be secured to a conventional power chisel having a chuck for receiving a chisel or chisel bit, a punch or punch bit, and a riveting bit. When the power chisel is driven by a conventional power source, such as compressed air, the chisel is used to remove the head from a rivet associated with an element, as, for example, sections of a sickle bar of a combine, a hay conditioner, a mowing machine or the like. Once the chisel has been used to cut off the heads of the old rivets, the tool is utilized in conjunction with the punch to drive the rivet outwardly from its associated hole, and thereafter the riveting bit is utilized in conjunction with an anvil to upset the stem or shank of a new rivet to secure a new section to the sickle bar, combine or the like. Thus, the tool of the present invention can rapidly remove the heads from old rivets to remove sections of an associated sickle bar or the like, punch these rivets from the section of the sickle bar which is to be removed, and thereafter upsetting the heads of new rivets to secure a new section to the sickle bar. Since the speed at which the latter-noted functions are performed by the tool of this invention is quite high, down-time and labor are reduced, the sickle bar need not be removed to change a section, and the associated blades or sickle bars are not bent as can occur when conventional mechanical tools are utilized. Thus, the single tool and three bits can be utilized in the field for rapid changeover at minimum time and maximum utilization of labor.

In further accordance with this invention, the tool preferably includes a collar which is secured by set screws to the chuck end portion of a conventional air-driven chisel and the collar carries a sleeve into which is slidably mounted a rod carrying an arm which underlies the rivet whose head has been removed with a bore and the arm being designed to pass therethrough a rivet driven from the section by the associated punch or punch bit. Thus, after the necessary heads from all of the rivets have been removed, the tool can be readily moved from rivet to rivet to drive or punch the rivets from the element with attendant speed and efficiency.

In further accordance with the latter-noted object, once all rivets have been removed and an appropriate section replaced, new rivets can be riveted by utilizing a cylindrical stem housed within the bore of the arm and underlying the head of a new rivet in alignment with a riveting bit of the chisel which when energized upsets the new rivet shank, thus riveting and reassembling desired elements with like speed and efficiency.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
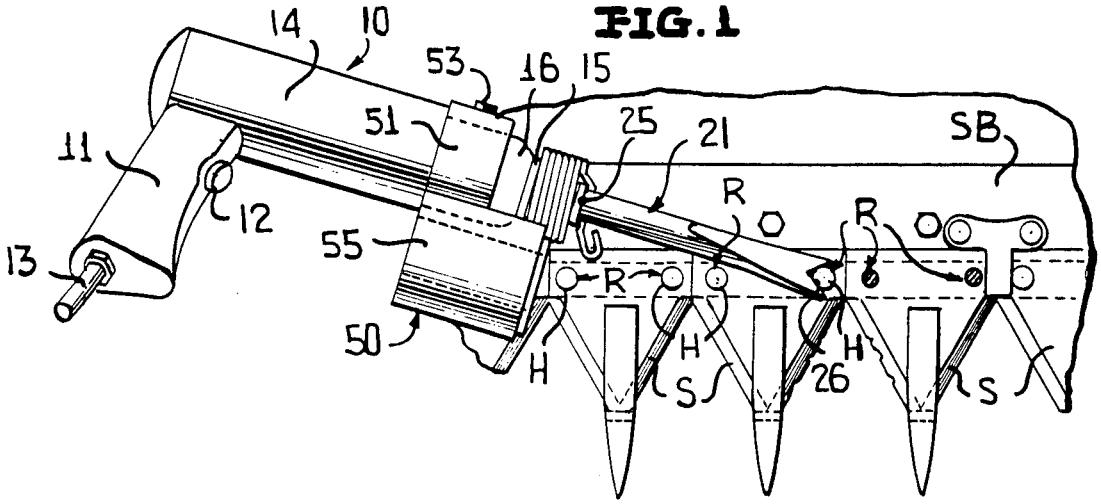
FIG. 1 is a perspective view of a conventional air chisel with a part of the tool of this invention carried thereby, and illustrates a chisel or chisel bit being utilized to remove the head from the rivet to remove a section from a sickle bar.
Figures 4, 5, 6, 7, 8:
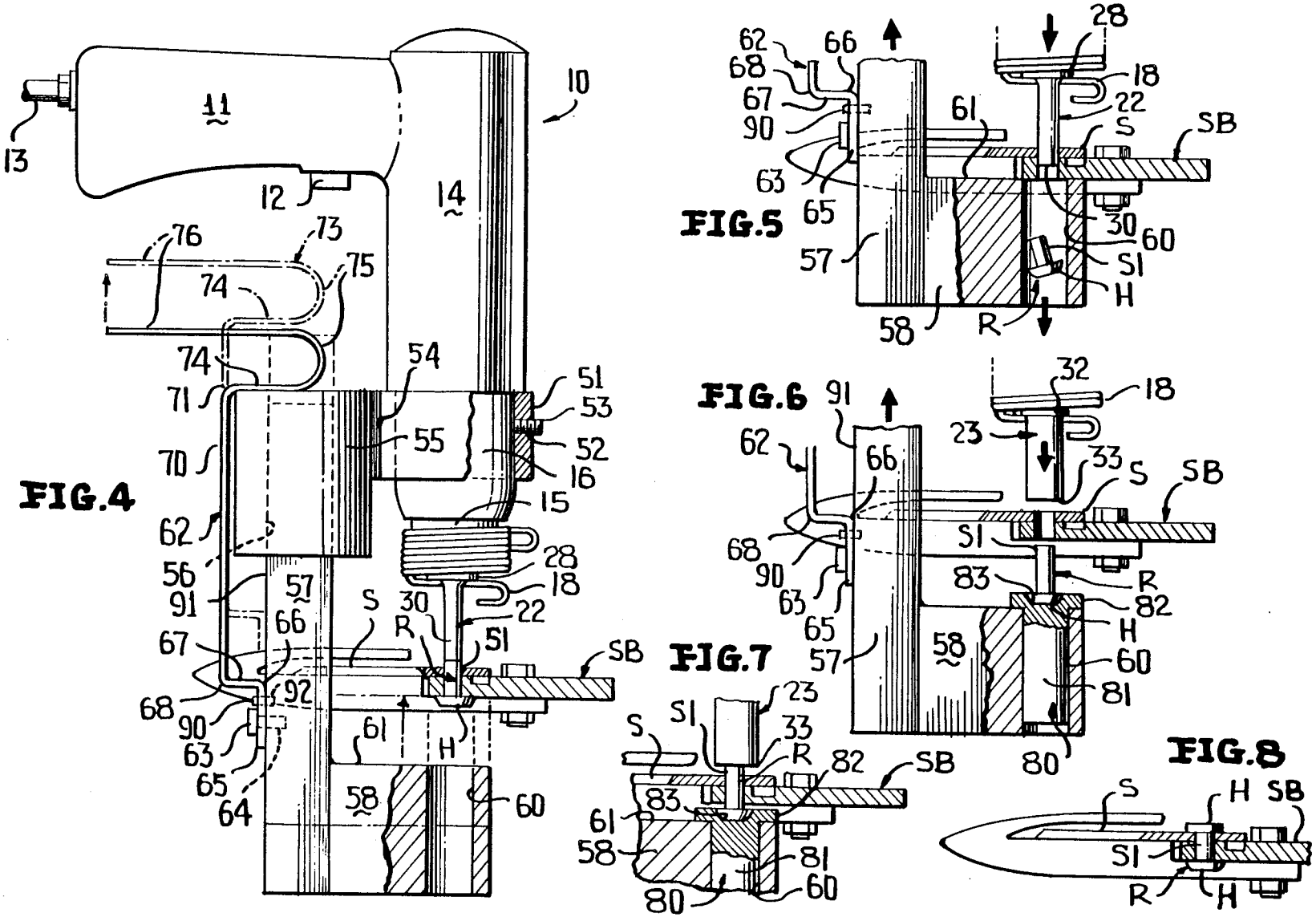
FIG. 4 is a side elevational view with portions broken away and shown in cross-section for clarity of the tool of this invention, and illustrates the punch carried by the air chisel along with the headless rivet for driving the same downwardly while being backed-up by the tool arm.
FIG. 5 is a fragmentary sectional view similar to FIG. 4, and illustrates the manner in which the rivet is removed by the punch and passes through the bore of the arm.
FIG. 6 is a cross-sectional view similar to FIG. 5, and illustrates a riveting bit carried by the air chisel and the anvil carried by the arm prior to the shank of a new rivet being introduced into aligned openings of associated elements which are to be riveted together.
FIG. 7 is a fragmentary cross-sectional view similar to FIG. 6, and illustrates the anvil holding the rivet preparatory to the shank being upset by the riveting bit.
FIG. 8 is a side elevational view, partially in cross-section, and illustrates the completion of the riveting operation.

An air-operated chisel of a conventional construction is best shown in FIGS. 1 and 4 of the drawings and is generally designated by the reference numeral 10. The air chisel 10 includes a handle or grip 11 having a push-button 12 for selectively conducting air from a high pressure source (not shown) through a pressure line 13 to an internal mechanism (not shown) within a body 14 of the air chisel for reciprocating and/or vibrating a chuck 15 carried by a reduced chuck end portion 16. The chuck 15 receives anyone of a plurality of tools or bits which are generally designated in FIG. 2 by reference numerals 21, 22, and 23, and each of the bits is retained in a bore (not shown) of chuck 15 by a retaining spring 18.

Figure 2:
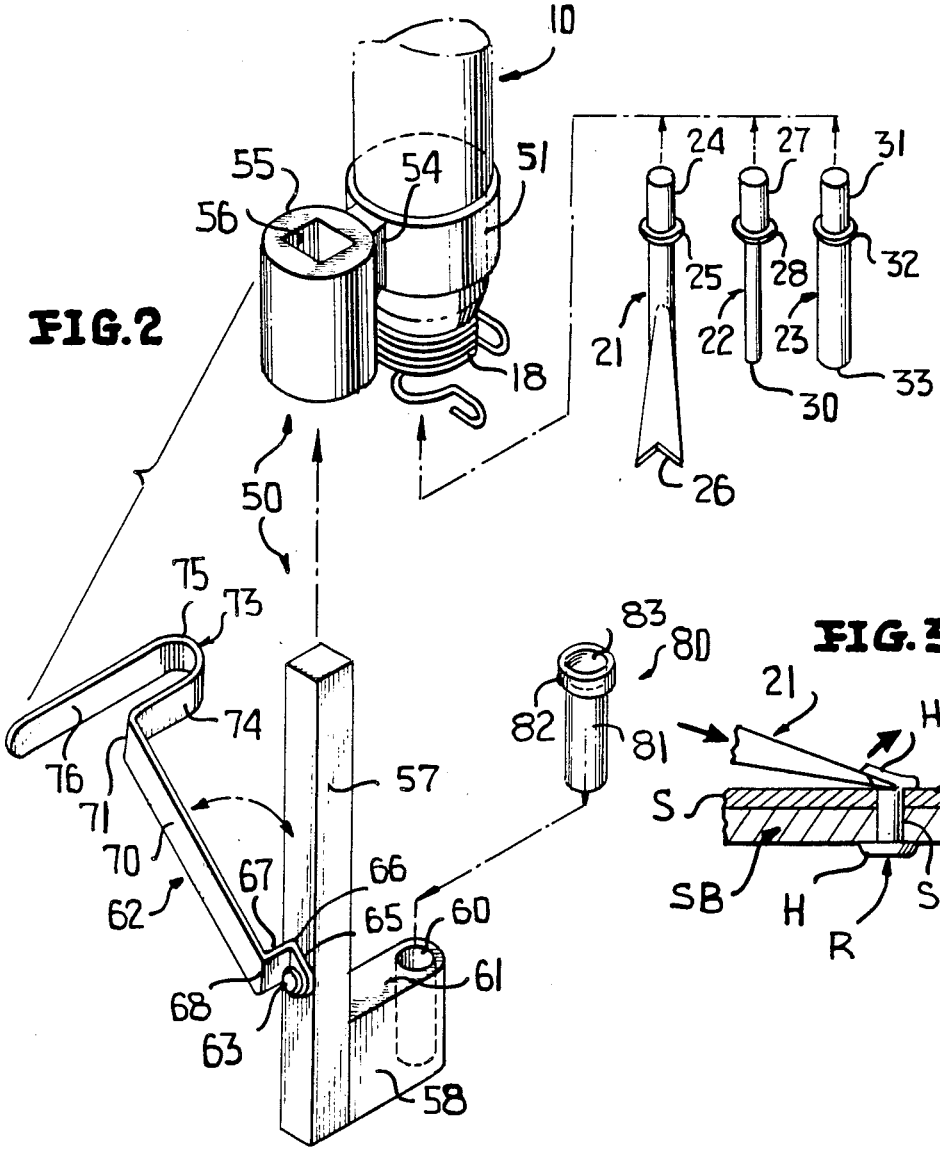
FIG. 2 is an exploded perspective view of the tool of FIG. 1 in its entirety, and illustrates a bore in an arm carried by a rod which is designed for sliding association with the bore of a sleeve and a cylindrical anvil adapted for insert in the arm bore along with three bits.

As is best illustrated in FIG. 2, the bit 21 is a chisel or chisel bit having a chucking end 24, a collar 25 and a sharpened generally V-shaped edge 26. The bit 22 is a punch bit which likewise includes a chucking end 27, a collar 28 and a punch end 30 of a cylindrical configuration corresponding generally to the diameter of a rivet shank which is to be removed in a manner to be described more fully hereinafter. The bit 23 is a riveting bit which likewise includes a chucking end 31, a collar 32, and a riveting end or upsetting end 33. The end 33 of the riveting bit 23 upsets the shank of a new rivet, again as will be described more fully hereinafter. In each case the collars 25, 28 and 32 are utilized to removably connect the bits 21 through 23 to the chuck 15 of the air chisel 10.

Reference is specifically made to FIGS. 2 and 4 of the drawings in which a novel tool adapted for use with the air chisel 10 is fully illustrated and is generally designated by the reference numeral 50.

The tool 50 in association with the chisel 10 is designed specifically to remove rivets R from a sickle bar SB of a combine, or from hay conditioners or mowing mechines to remove therefrom a number of sections S which are normally secured to the sickle bar SB by the rivets R. The sections S can become dull, damaged or broken, and, therefore, it is highly desirable to remove the rivets R, particularly while in-the-field, replace the worn sections S by other sections, and rerivet the new sections S to the sickle bar, and the latter is accomplished by the tool 50 of this invention in conjunction with, of course, the air chisel 10.

Figure 3:
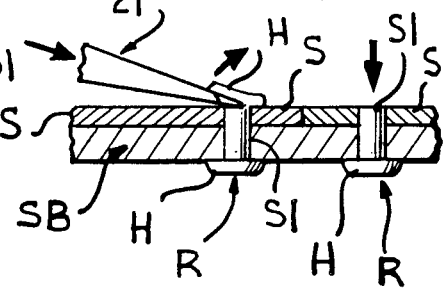
FIG. 3 is a fragmentary sectional view taken generally along line 3—3 of FIG. 1, and illustrates a rivet whose upper head has been removed and another rivet head being removed by the chisel.

The air chisel 10 is used in a conventional manner to remove heads H from rivets R by utilizing the chisel or chisel bit 21 in the manner best illustrated in FIGS. 1 and 3 of the drawings. As the chuck 15 reciprocates, the chisel bit 21 likewise reciprocates and the edge 26 thereof severs the head H (FIG. 3) from an associated shank S1 of anyone of the rivets R which are to be removed to remove selected ones of the sections S. There are two rivets R associated with each section S in FIG. 1, and, therefore, if any particular section S is to be removed, the two rivets associated therewith must have the heads H removed, and several of the heads are shown removed in FIGS. 1 and 3. Of course, once the heads H have been removed, the rivets must be driven or punched out from the associated bores (unnumbered) of the sections S and the sickle bar SB, and it is toward the latter end that the tool 50 is operative in conjunction with the punch or punching bit 22.

The tool 50 includes means for removably securing the tool to the chuck end portion 16 of the air chisel 10 in the form of a generally annular collar 51 having two or more radial threaded bores 52, each of which receives a set screw 53. The collar 51 is simply slipped upon the end portion 16 of the air chisel 10 and upon the tightening of the set screws 53, the tool 50 is retained on and carried by the air chisel 10.

The collar 51 has secured thereto by a short radial arm 54 and appropriate welds (not shown) a generally cylindrical sleeve 55 having a central bore or opening 56 of a rectangular cross-sectional configuration which slidably receives a like cross-sectioned leg or rod 57 having welded at its lowermost end portion (unnumbered) supporting means in the form of an arm 58 having a cylindrical through bore 60 therein and an uppermost generally flat abutment surface 61. Handle means generally designated by the reference numeral 62 is secured for pivoting movement relative to the rod 57 by means of a pivot pin 63. The pivot pin 63 passes through an aperture 64 (FIG. 4) of a terminal end portion 65 of the handle means 62. The terminal end portion 65 is in turn joined by an integral bend or fold line 66 to an offset portion 67 which is in turn joined by a bend or fold line 68 to a main body 70 of the handle means 62 which in the position shown in FIG. 4 is in generally aligned parallel relationship to the rod 57. The main body 70 is joined by a bend 71 to a loop or projection 73 defined by a leg 74, a bight 75, and another terminal leg 76. When the handle means 62 is positioned with its main body 70 aligned with the rod 57, the leg 74 overlies the sleeve 55 (FIG. 4) and prevents the rod 57 and all of the elements carried thereby from simply dropping downwardly, outwardly through the bore 56 of the sleeve 55. Furthermore, when one holds the grip 11 of the air chisel 10 in a conventional manner, the terminal leg 76 can be gripped by the index finger and the remaining fingers to pull the projection 73 upwardly or allow the same to drop downwardly, as indicated between the solid and phantom outline positons in FIG. 4 to elevate or lower the arm 58 in a manner and for purposes to be described more fully hereinafter.

The cylindrical bore or opening 60 is also sized larger than the diameter of the heads H of the rivets R and the size is such as to accommodate a cylindrical stem 81 of anvil means 80 having an enlarged head 82 with an upperwardly opening concave recess 83 which is likewise of a diameter to accommodate the head H of a conventional rivet R.

Assuming that the head H of the rivet R shown in FIG. 1 has been removed in a manner heretofore described and all of the rivets remain fast in the openings (unnumbered) associated with the sections S and the sickle bar SB, these now headless rivets, at least insofar as the tops of the rivets are concerned, must be driven or punched out from their associated openings. In order to accommodate the latter function, the tool 50 is now utilized by positioning the generally flat abutment surface 61 in the manner shown in FIGS. 4 and 5 against the underside of the sickle bar SB with the bore 60 in alignment with the rivet R which is to be removed. At this point, the punch or punch bit 22 is, of course, housed in the bore (unnumbered) of the chuck 15 and is aligned with the shank S1 of the rivet R shown in FIGS. 4 and 5. When the trigger or switch 12 is depressed and the punch bit 22 reciprocates the end 30 successively and repetitiously pounds downwardly against the rivet in FIG. 4, while at the same time the leg 76 is drawn upwardly by the fingers of the person utilizing the air chisel 10. The latter mainatains the abutment surface 61 in constant contact with the sickle bar SB and, therefore, provides back-up for the repetitious forces exerted by the punch end 30 against the rivet R (FIG. 4) until the rivet R is driven outwardly and discharged through the bore 60, as is diagrammatically illustrated in FIG. 5 of the drawings. Obviously, when both rivets R associated with each section S have been removed, the section S can itself be removed from the sickle bar and a new section replaced thereon, as is indicated in FIG. 6. Before riveting the new section S (FIG. 6) to the sickle bar SB, the punching bit 22 is removed and replaced by the riveting bit 23 and the anvil 80 is connected to the arm 58 simply by sliding the cylindrical stem 81 into the bore 60. Thereafter, a new rivet R (FIG. 6) is seated with its head H within the recess 83 of the enlarged head 82 of the anvil 80 and with the rivet aligned with the bores of openings (unnumbered) of the sickle bar SB and the section S the terminal leg 76 of the handle means 62 is pulled upwardly which draws the rod 57 and the arm 58 likewise upwardly to position the shank of the rivet in the manner shown in FIG. 7 at which point the head H of the rivet R in FIG. 7 is confined in the recess 83 and supported by the anvil 80, while the end face or end 33 of the riveting bit 23 contacts the shank S1 of the rivet. When the trigger 12 is actuated, the riveting bit 23 again reciprocates progressively upsetting the shank S1 of FIG. 7 until a new rivet R headed at both ends, as at H,H in FIG. 8, is formed, and the same punching and riveting process is repeated until all of the sections S have been removed, new sections replaced and new rivets formed as shown in FIG. 8.

Reference is made to FIGS. 4, 5 and 6 of the drawings which illustrates a pin 90 carried by the rod 57 and projecting slightly upwardly beyond a surface 91 of the rod 57. The pin 90 is received in a bore 92 formed in the end portion 65 of the handle 62 when the latter, and particularly the main body 70, is aligned with the rod 57. When the bore 92 receives the pin 90, the handle 62 is locked in the position best shown in FIG. 4 and, therefore, the tool is easier to use and the handle 62 can not inadvertently or accidentally swing out of alignment with the rod 57, as, for example, shown in FIG. 2. However, if it is desired to more the handle 62 and particularly the main body 70 out of alignment with the rod 57, the handle 62 and the main body portion 70 is simply bent away from the surface 91 which frees the pin 90 from the bore or opening 92. The handle 62 and the main body 70 thereof is preferably made of repoundable material and, therefore, when the handle is released, it assumes its "normal" position, as shown in FIGS. 2 and 4 of the drawings.

Although only a preferred embodiment of the invention has been specifically illustrated and described herein, it is to be understood that minor variations may be made in the apparatus without departing from the spirit and scope of the invention, as defined in the appended claims.

I claim:

1. A power tool adapted for use with power bits to remove old rivets and reapply new rivets relative to an associated riveted element comprising support means for underlying contactingly supporting an element adjacent an associated old rivet in alignment with a punch bit reciprocated by the power tool, means for removably securing said support means to the power tool, anvil means carried by said support means for underlyingly contactingly supporting a new rivet while a shank thereof is upset by a riveting bit reciprocated by the power tool, means for slidably connecting said support means relative to said securing means, said slidably connecting means includes a sleeve telescopically slidably receiving a rod, said support means being carried by said rod, said sleeve being defined by a portion of said removable securing means, means for preventing the inadvertent slidable disconnecting of said rod relative to said sleeve, said disconnecting preventing means including an elongated member connected at a first end thereof to said rod at an end of said rod adjacent said anvil, and said elongated member having a second end remote from said anvil in overlying relationship to an end of said sleeve remote from said anvil.

2. The tool as defined in claim 1, wherein said elongated member second end contacts said sleeve remote end upon relative sliding movement between said elongated member and said sleeve.

3. The tool as defined in claim 1 including means for preventing relative rotation between said sleeve and rod.

4. The tool as defined in claim 1 including means for preventing relative rotation between said sleeve and rod, said rotation preventing means being effected by mating polygonal matching shapes of said sleeve and rod.

* * * * *